United States Patent [19]

Tobias et al.

[11] Patent Number: 4,625,950

[45] Date of Patent: Dec. 2, 1986

[54] LEAD ALLOYING APPARATUS

[75] Inventors: Jackie L. Tobias, Muncie; Larry R. Kline; Ted O. Moser, both of Anderson, all of Ind.

[73] Assignee: General Motors Corporation, Detroit, Mich.

[21] Appl. No.: 754,237

[22] Filed: Jul. 12, 1985

[51] Int. Cl.[4] ..... F27B 17/00

[52] U.S. Cl. ..... 266/200; 266/216; 266/900

[58] Field of Search ..... 266/200, 210–212, 266/215, 216, 900

[56] References Cited

U.S. PATENT DOCUMENTS

| | | | |
|---|---|---|---|
| 40,472 | 11/1863 | Gerhardt | 266/216 |
| 2,408,467 | 10/1946 | Lyons | 266/200 |
| 2,585,404 | 2/1952 | Pierce | 266/216 |
| 3,547,622 | 12/1970 | Hutchinson | 266/216 |
| 3,788,629 | 1/1974 | Miller | 266/216 |
| 3,827,680 | 8/1974 | Wheeler | 266/216 |
| 3,917,125 | 11/1975 | Heinz et al. | 266/216 |
| 3,935,003 | 1/1976 | Steinke et al. | 266/200 |
| 4,080,200 | 3/1978 | Sheridan | 420/590 |
| 4,248,630 | 2/1981 | Balmuth | 420/590 |

FOREIGN PATENT DOCUMENTS

| | | | |
|---|---|---|---|
| 2549967 | 5/1977 | Fed. Rep. of Germany | 266/200 |

*Primary Examiner*—Christopher W. Brody
*Attorney, Agent, or Firm*—Lawrence B. Plant

[57] ABSTRACT

A system for alloying lead with minor amounts of alloyants which have a higher melting point than, and a lower solid solubility in, lead. The system includes a melting furnace retaining Pb melt at a first temperature, a sealed vessel containing chunks of alloyant-rich material, a heated conduit between the furnace and the vessel for conducting melt to the vessel while heating it to the melting temperature of the material in the vessel, a conduit for returning superheated melt from the vessel to the furnace and a pump for circulating a small portion of the melt from the furnace through the vessel for dissolution of the alloyant into that portion.

5 Claims, 1 Drawing Figure

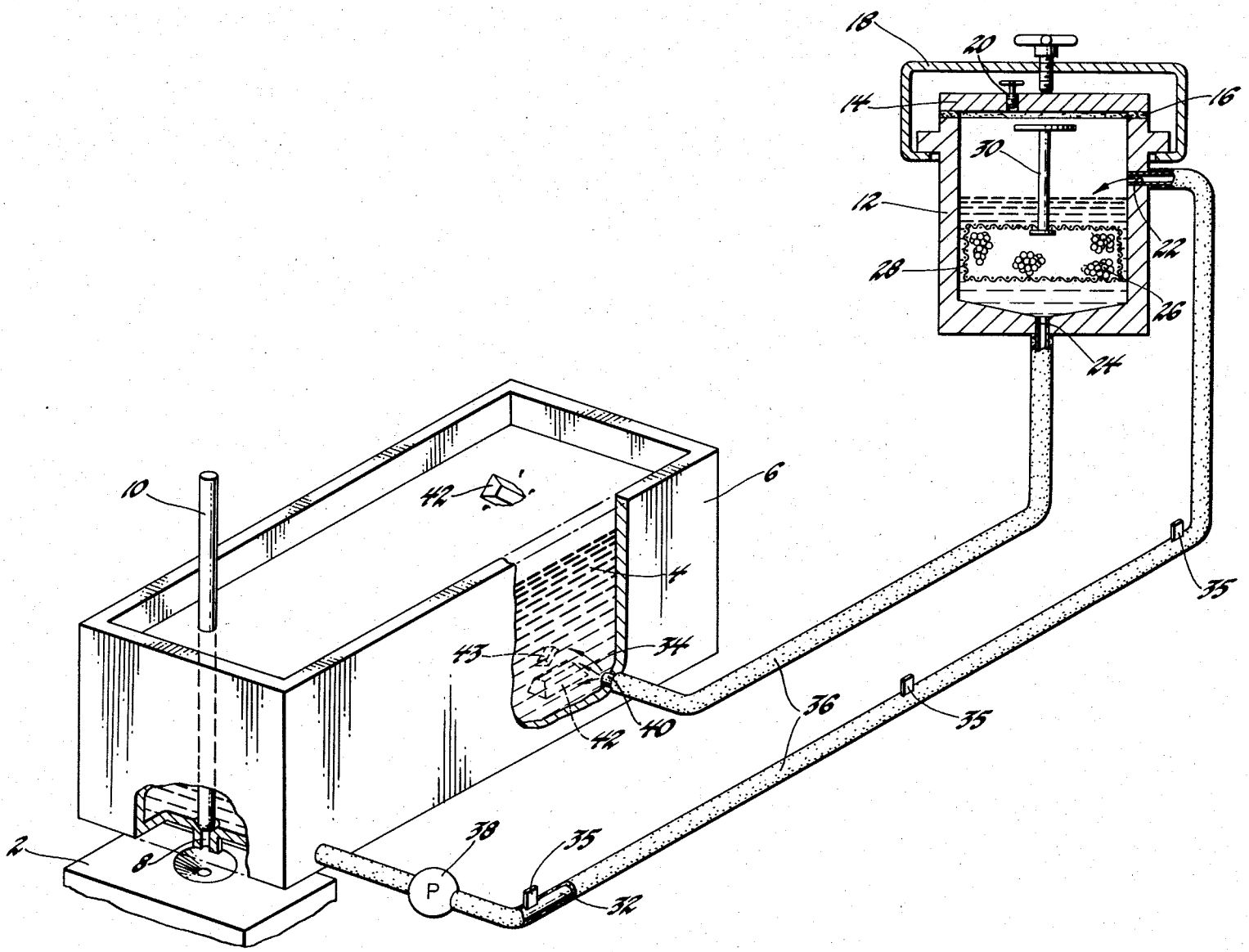
P

LEAD ALLOYING APPARATUS

This invention relates to apparatus and method for alloying lead with a minor amount of an alloyant which has a significantly higher melting point than, and a low solid solubility in, lead. The apparatus and method is particularly cost effective when used in conjunction with processes for the casting of Pb-acid battery grids or strip for making such grids.

BACKGROUND OF THE INVENTION

Lead-acid storage battery grids are made by a variety of casting techniques including (1) directly casting a lead alloy into a gridform such as by the processes disclosed in U.S. Pat. Nos. 3,789,910 or 4,415,016; or (2) casting a strip of the alloy (e.g., see Atkins et al U.S. Pat. No. 4,122,890), rolling the strip into a thin ribbon and thereafter expanding the ribbon into grids such as by the process disclosed in Daniels et al U.S. Pat. No. 3,945,097. Such processes require that large batches of molten lead alloy be prepared to insure a ready supply of melt of the proper composition for dispensing to the casting machines during the course of a production run. This is done by providing a large (e.g., 25 ton) melting furnace which is full of melt and maintained at about the casting temperature to be used. As casting progresses, the melt in the furnace is replenished by periodically charging the furnace with appropriate quantities of the alloy's ingredients. Lead hogs, prealloyed by the lead supplier, may be used to charge the furnace but are not cost effective. Rather, it is more cost effective for the manufacturer of the castings (hereafter casters) himself to add separate hogs of lead and pigs of each of the other ingredients (e.g., tin, calcium, etc.) to the melt in the furnace as required to maintain an adequate supply of melt therein. The addition of solid hogs (i.e., 1920 lbs.) and of smaller pigs of the other ingredients tend to chill the melt and thereby create a demand for additional direct heat to be added to the furnace by the furnace's heaters in order to maintain the casting temperature. Moreover, such additions temporarily disrupt the homogeneity of the melt composition in the furnace until the hogs/pigs dissolve and mix with the rest of the melt.

The addition of even minor amounts (i.e., less than about 0.06% by weight) of alloyants such as Al, Cu or Ni which have a solid solubility in lead of less than 0.06% by weight under equilibrium conditions (hereafter low lead solubility), and a much higher melting point than lead cannot be added so simply and have heretofore required superheating of all the melt in the furnace to ensure dissolution of the alloyant. In this regard for example, at least one manufacturer of lead hogs prealloyed with about 0.02 weight % Al prepares a 73% Ca and 27% Al master alloy which melts at about 1100° F., heats an entire batch of melt up to about 1100° F., plunges the master alloy beneath the melt, agitates the melt and continues the process until all of the master alloy is dissolved and thoroughly mixed throughout. Thereafter the melt is cast into hogs which are then cooled back down to room temperature for shipment. Such practices waste heat and time, place an unnecessary thermal strain on the melting furnace and add to the cost to purchasers of the hogs. Were a casting manufacturer to add such alloyants in the same manner at the casting site, he would experience essentially the same disadvantages as the hog supplier.

Accordingly, it is an object of the present invention to provide a lead alloying system including process and apparatus for simply and economically alloying large batches of lead with a minor amount of a low-lead-solubility, high-melting alloyant in a minimum amount of time and with a minimum amount of additional heat so as not to delay the process, add to the heating expense or place an unnecessary thermal stress on the melting furnace. It is another object of the present invention to utilize such an alloying system as part of a complete casting operation. These and other objects and advantages of the present invention will become more readily apparent from the detailed description thereof which follows.

BRIEF DESCRIPTION OF THE INVENTION

The present invention comprehends a system (i.e., process and apparatus) for alloying lead with minor amounts (i.e., less than about 0.06% by weight) of an alloyant having a low lead solubility and a much higher melting point than lead. The system offers particular advantages for use: with alloyants which have a lower specific gravity than lead so as to reduce segregation due to floatation; and with readily oxidizable metals such as, aluminum, to reduce dross in the furnace. The system is seen to have the most overall cost effectiveness when integrated directly into the casting operation in the casting plant for on-site preparation of the casting alloys. Hence, the preferred system will include, (1) a lead casting machine, (2) a melting furnace for retaining and dispensing lead melt to the casting machine at a first temperature near the casting temperature, (3) a sealed dissolution vessel in side-stream relation to the melting furnace and housing chunks of a master alloy containing the minor alloyant, (4) a heated conduit communicating the melting furnace with the inlet to the dissolution vessel for conducting a relatively small portion (e.g., about 4%) of the melt in the furnace to the dissolution vessel while superheating that portion to a second temperature which is at least about the melting temperature of the master alloy in the dissolution vessel, (5) a second conduit communicating the outlet of the dissolution vessel with the furnace for returning the superheated, alloyant-enriched portion back to the furnace, (6) porous means (i.e., a filter, or the like) for preventing the master alloy chunks from entering the second conduit before substantial dissolution thereof, and (7) a pump for circulating the melt from the furnace through the conduits and vessel and back to the furnace.

The dissolution vessel will have a sealable cover, an inlet, an outlet, and preferably a relatively large volume in relation to the size of the inlet and outlet so as to provide sufficient residence time to achieve the most effective enrichment of the melt therein with the alloyant from the master alloy. The dissolution vessel will preferably be positioned above the level of the melt in the melting furnace to facilitate draining of the melt therefrom back into the furnace when the time comes to recharge the vessel with master alloy. The master alloy chunks will preferably be contained in a fine mesh wire basket, or the like, which, like a filter, serves to substantially prevent any undissolved master alloy from escaping the vessel into the furnace. Such a basket would facilitate handling of the master alloy and permit ready removal thereof from the vessel should the need arise. Alternatively, a simple screen, perforated plate or other porous material positioned between the master alloy and the vessel's outlet would suffice.

In operation, a small portion of melt from the melting furnace is conducted to the dissolution vessel via a heated conduit which superheats the portion from the temperature maintained in the melting furnace up to at least about the melting temperature of the master alloy in the dissolution vessel. The superheated portion then flows through the bed of master alloy chunks so as to elevate the temperature thereof and eventually dissolve them into the side-stream portion for transport of the constituents thereof back to the melting furnace. Circulation and superheating of the melt continues at least until all of the master alloy in the dissolution vessel has dissolved. The dissolution rate of the master alloy chunks can be controlled by varying the flow rate and/or temperature of the side-stream portion of the melt flowing through the dissolution vessel as well as by varying the size and composition of the master alloy chunks. Chunks having a diameter of about one and one half inches are expected to be the most useful in that they are seen to be easy to handle and dissolve. Very small particles are to be avoided for dust and handling reasons as well as their greater tendency toward oxidation. Larger blocks may be used but take longer to dissolve. Circulation may continue after dissolution of the master alloy is complete to promote mixing of the enriched portion with the remainder of the melt in the casting furnace and to relieve some of the direct heating of the furnace by the furnace heaters.

During the course of a production run, the melt in the melting furnace is replenished by adding appropriate amounts of lead and other major ingredients (e.g., tin) directly to the melting furnace and providing a corresponding amount of the minor alloyant(s) in the dissolution vessel for consumption by the circulating melt portion. In this regard, according to the preferred process of the present invention, the lead and other major ingredients are charged directly into the melting furnace as solid pieces (e.g., as hogs, pigs, etc.) and such as to settle to within the thermal vicinity of the site where the superheated, alloyant-enriched side-stream returns to the furnace. The expression "thermal vicinity" is used herein to mean that localized zone of melt around the site where the return stream enters the furnace which is heated by the return stream to a temperature above that of the surrounding melt. Most preferably, the solid pieces will settle into the direct path of the stream of superheated melt flowing into the furnace; so positioning the solid pieces bathes them in moving, superheated alloyant-rich melt which accelerates their melting and mixing with the bulk of the melt.

Hence, the apparatus of the present invention can be used effectively: to minimize the heat energy required to formulate and replenish certain casting alloys; to substantially prevent floatation, and resulting segregation, of undissolved alloyant in the melt; to minimize drossing that occurs as a result of the oxidation of oxygen sensitive materials (e.g., calcium); and to promote rapid dissolution of the low solubility alloyants.

The present invention may better be understood when considered in the light of the following detailed description of one specific embodiment thereof which is given hereafter in conjunction with the single drawing which diagrammatically depicts the apparatus and method of the present invention.

The FIGURE depicts a lead casting system including the alloying apparatus and method of the present invention. A lead casting machine 2 (tundish only shown) is positioned to receive melt 4, by gravity flow, from an overhead melting furnace 6. A pouring nozzle 8 in the bottom of the furnace 6 directs melt 4 into the casting machine 2 and is controlled by reciprocating stopper rod 10, in known fashion. A dissolution vessel 12 is located above the level of the melt 4 in the furnace 6 and plumbed in side-stream relation thereto as illustrated. The vessel 12 is sealed with a cover 14 via a heat insulating gasket 16. The cover 14 is held in place by an appropriate clamping arrangement 18 as shown. A vent plug 20 in the cover 14 permits complete draining of the vessel 12 when not in use. The vessel 12 is provided with an inlet 22 near the upper portion thereof and an outlet 24 at substantially the lowest point thereof for respectively receiving superheated dilute melt from the furnace 6 and returning alloyant-rich melt back to the furnace 6. Master alloy chunks 26 containing the high melting, low-solubility alloyant (e.g., Al) are enclosed within a fine mesh wire basket 28 and positioned within the vessel 12 by means of the handle 30.

An electrically heated conduit 32 communicates the casting furnace 6 with the inlet 22 of the dissolution vessel 12 and is of sufficient length to superheat the melt 4 from above the pouring temperature in the furnace up to at least about the melting temperature of the master alloy 26 in the basket 28. The heated conduit 32 is impedence heated by connecting an appropriate transformer to the lugs 35 which are connected directly to the conduit 32 in known fashion (see commercially available electrically heated pipe available from the Electric Pipe Division of the Ric-Wil Co.). Insulation 36 covers the conduit 32 to minimize heat losses. A pump 38 circulates the melt 4 from the furnace 6 through the dissolution vessel 12 and back to the furnace 6. The conduits 32 and 40 respectively exit and enter the melting furnace 6 so as to provide the most effective mixing of the alloyant-enriched stream 34 with the remainder of the melt 4. In some instances, multiple inlets and outlets may be provided to and from the furnace 6 in order to achieve more rapid mixing of the melt.

During the course of a production run, melt 4 in the furnace 6 becomes depleted and needs to be replenished to ensure a continuous operation. Replenishment is preferably achieved by charging the furnace 6 with a hog(s) 42 of lead and pig(s) 43 of other ingredients such that the hog(s)/pig(s) settle down into the furnace in the thermal vicinity of the incoming stream of superheated melt 34 which provides a hotter zone in the furnace to accelerate melting of the hog(s)/pig(s). The hogs 42 will most preferably be placed directly in the flow path of the incoming stream 34 for more rapid melting and disposition throughout the melt.

In one specific example of the invention, the melting furance 6 is initially charged with lead alloy containing about 0.7% by weight tin as a major constituent, and heated to a pouring temperature of about 760° F. Thereafter an appropriate amount of master alloy chunks (i.e., one and one-half inch diameter), containing about 73% Ca and 27% Al, is placed in the basket 28 of the dissolution vessel 12 and circulation of the superheated melt portion therethrough begun. More specifically, the melting furnace 6 is charged with about 24.8 tons of lead and 350 lbs. of tin, and the dissolution vessel is charged with 35 lbs. of the Ca-Al master alloy 26. A side-stream portion of the melt is pumped at a rate of about 500#/min. through the dissolution vessel after having been heated in a one and one-half inch diameter heated conduit 32 to a temperature of at least about 1100° F. (i.e., the melting temperature of the Ca-Al master alloy). Circulation continues at least until the master alloy is consumed (i.e., estimated to be about 4 minutes). Thereafter, as the furnace becomes depleted of melt, it may be replenished in the same manner described above.

While the alloying system of the present invention has been disclosed primarily as an integral part of a casting process, as it would be used by a caster, it is to be understood that it would also be useful to manufacturers of prealloyed hogs for supply to such casters. Accordingly the invention is not limited by the embodiment specifically disclosed but rather only to the extent set forth hereafter in the claims which follow.

The embodiments of the invention in which an exclusive property or privilege is claimed are defined as follows:

1. Lead-alloying apparatus including a furnace for retaining melt at a first temperature and means associated with said furnace for introducing into said melt less than about 0.06% by weight of an alloyant having a melting point significantly higher than said melt temperature and an ambient temperature solid solubility in lead less than 0.06% by weight said means comprising:

a sealed vessel containing an alloyant-rich master alloy for dissolution into, and alloyant-enrichment of, a relatively small superheated portion of said melt withdrawn from said furnace, said vessel having an inlet for receiving said portion from said furnace, an outlet for returning said alloyant-enriched portion to said furnace, and porous means between said inlet and outlet for substantially containing undissolved master alloy within said vessel;

a heated conduit communicating said furnace with said inlet for conducting said portion from said furnace to said vessel while superheating said portion to at least about the melting temperature of said master alloy;

a return conduit communicating said outlet with said furnace for conducting said alloyant-enriched portion from said vessel to the furnace; and means for circulating said portion from said furnace through said conduits and vessel and back to said furnace to dissolve said master alloy into said portion as said portion circulates therethrough.

2. Apparatus according to claim 1 wherein said porous means comprises a basket containing said master alloy.

3. An integrated lead-alloying and casting apparatus including a lead casting machine, a furnace for dispensing lead melt to said casting machine at a casting temperature and means associated with said furnace for introducing into said melt less than about 0.06% by weight of an alloyant having a melting point significantly higher than said casting temperature and an ambient temperature solid solubility in lead less than 0.06% by weight said means comprising:

a sealed vessel in side-stream relation to said furnace and containing an alloyant-rich master alloy for dissolution into, and alloyant-enrichment of, a relatively small superheated portion of said melt, said vessel having an inlet for receiving said portion from said furance, an outlet for returning said alloyant-enriched portion to said furnace, and porous means between said inlet and outlet for substantially containing undissolved said master alloy within said vessel;

a heated conduit communicating said furnace with said inlet for conducting said portion from said furnace to said vessel while superheating said portion to at least about the melting temperature of said master alloy;

a return conduit communicating said outlet with said furnace for conducting said alloyant-enriched portion from said vessel to the furnace; and means for circulating said portion from said furnace through said conduits and vessel and back to said furnace to dissolve said master alloy into said portion as said portion circulates therethrough;

whereby, in operation of said apparatus, melt in said furnace may be enriched with said alloyant without significantly raising the temperature of the entire melt in the furnace.

4. Apparatus according to claim 1 wherein said porous means comprises a basket containing said master alloy.

5. Alloying apparatus including a furnace for retaining metal melt at a first temperature and means associated with said furnace for introducing into said melt an alloyant having a melting point higher than said melt temperature said means comprising:

a sealed vessel containing an alloyant-rich master alloy for dissolution into, and alloyant-enrichment of, a relatively small superheated portion of said melt withdrawn from said furnace, said vessel having an inlet for receiving said portion from said furnace, an outlet for returning said alloyant-enriched portion to said furnace, and porous means between said inlet and outlet for substantially containing undissolved master alloy within said vessel;

a heated conduit communicating. said furnace with said inlet for conducting said portion from said furnace to said vessel while superheating said portion to at least about the melting temperature of said master alloy;

a return conduit communicating said outlet with said furnace for conducting said alloyant-enriched portion from said vessel to the furnace; and means for circulating said portion from said furnace through said conduits and vessel and back to said furnace to dissolve said master alloy into said portion as said portion circulates therethrough.

* * * * *